US011668312B2

(12) United States Patent
Huang et al.

(10) Patent No.: US 11,668,312 B2
(45) Date of Patent: Jun. 6, 2023

(54) AIR PUMP FOR AN INFLATABLE BODY

(71) Applicant: BESTWAY INFLATABLES & MATERIAL CORP., Shanghai (CN)

(72) Inventors: Shuiyong Huang, Shanghai (CN); Wanbin Qiu, Shanghai (CN); Ruoxun Yin, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 761 days.

(21) Appl. No.: 16/721,867

(22) Filed: Dec. 19, 2019

(65) Prior Publication Data

US 2020/0200180 A1 Jun. 25, 2020

(30) Foreign Application Priority Data

Dec. 24, 2018 (CN) ..... 201822170007.4

(51) Int. Cl.

| | |
|---|---|
| ***F04D 27/00*** | (2006.01) |
| ***F04D 25/08*** | (2006.01) |
| ***F04D 15/00*** | (2006.01) |
| ***F04D 25/16*** | (2006.01) |

(52) U.S. Cl.

CPC ..... *F04D 27/005* (2013.01); *F04D 15/0005* (2013.01); *F04D 25/08* (2013.01); *F04D 25/16* (2013.01); *F05D 2270/301* (2013.01); *F05D 2270/62* (2013.01)

(58) Field of Classification Search

CPC ..... F04D 15/00; F04D 15/0005; F04D 25/08; F04D 25/16; F05D 2270/62; F05D 2270/301; F16K 11/08; F16K 11/085; F16K 11/85; F16K 31/54

See application file for complete search history.

(56) References Cited

U.S. PATENT DOCUMENTS

2010/0247352 A1* 9/2010 Hansen ..... F04D 13/06 29/888.02
2017/0280884 A1* 10/2017 Liu ..... F04D 25/084
2018/0335042 A1* 11/2018 Lin ..... F04D 27/008

OTHER PUBLICATIONS

Extended European Search Report dated Feb. 21, 2020 (dated Feb. 21, 2020) issued on related European patent application 19217289.8 by the European Patent Office.

* cited by examiner

*Primary Examiner* — Philip E Stimpert
(74) *Attorney, Agent, or Firm* — Dickinson Wright PLLC

(57) ABSTRACT

An air pump comprises a controller, a pump, a driving switch and a pressure sensor. The controller includes a central processing unit and defines an air inlet. The pump couples to the controller to inflate or discharge air from an inflatable body. The pump comprises a housing defining an inflating and a discharging port. The driving switch couples to the controller to implement switching between two or more air passage configurations. The pressure sensor couples to the central process unit to detect an internal pressure value of the inflatable body. The controller includes a wireless communication module which communicates with the central processing unit and a mobile terminal. The mobile terminal includes a terminal wireless communication module and a terminal input unit. The terminal wireless communication module communicates with the wireless communication module. The terminal input unit provides at least an inflation, a deflation, or a stop signal input.

14 Claims, 7 Drawing Sheets

AIR PUMP FOR AN INFLATABLE BODY

CROSS REFERENCE TO RELATED APPLICATION

This application claims priority to Chinese Application Serial Number CN201822170007.4, filed on Dec. 24, 2018, the entire disclosure of which is incorporated herein by reference.

RELATED FIELD

The present invention generally relates to electric air pumps and, more particularly, to an electric air pump for an inflatable body.

BACKGROUND

Common inflatable products in the market, such as inflatable beds, inflatable mattresses, inflatable boats and inflatable toys, are widely favored by consumers because they are lightweight, foldable, easy to carry and comfortable. Air pumps, used with inflatable products, may include a manual inflatable pump, a hand-held electric air pump and a built-in electric air pump, of which the built-in electric air pump is more widely used, since it has an air-passage switch device and can achieve a high inflation speed while being convenient to use.

When inflating inflatable products, e.g. an inflatable mattress, insufficient inflation pressure will cause the mattress to be soft without sufficient support for the user. On the other hand, excessive inflation pressure will cause the inflatable mattress to deform or break. In the absence of a barometer, the internal pressure of the inflatable products can only be sensed by manually pressing the inflatable product upon inflation to control the inflation pressure. This process can be time-consuming and inaccurate. In addition, most inflatable products, such as inflatable mattresses, are made of thermoplastic rubberized fabric, which expands and deforms to a certain degree after being inflated, thereby causing attenuation of the internal pressure value and making it difficult to maintain the inflatable products in a relatively constant pressure range for a long period of time. Even if a current built-in electric air pump can include switching functions of inflating, discharging and stopping configurations, these switching functions are manually operated, and therefore, cannot automatically and accurately control the internal pressure value of an inflatable product, as well as timely inflating, discharging, or supplementing airflow operations. Accordingly, users can only manually inflate an inflatable product, which is inconvenient and may damage the inflatable product thereby affecting the service life of the inflatable product.

In some improvements, a built-in electric air pump may include wire-controlled built-in air pump or panel-controlled built-in air pump. However, to control the operation of the air pump, these air pumps need the user to operate a wire-controlled handle or contact a control panel of the air pump. Once the wire-controlled handle is damaged or lost, or the control panel fails, the operation of the air pump becomes inoperable. Also, due to the location of the inflatable product, sometimes the control panel cannot be easily accessed by the user, which will result in a bad user experience.

SUMMARY

To overcome the above-mentioned defects in the prior art, the present invention provides an air pump, which can be remotely controlled through wireless functions to perform the operation of inflating, discharging and/or supplementing airflow. When used in connection with inflatable products, the user can operate the inflatable product from anywhere, as long as the power supply of the product remains on, which simplifies the preparation work before use and the arrangement work after use.

The present invention provides an air pump for an inflatable body. The air pump comprises a controller having a panel located outside of the inflatable body. The panel defines an air inlet in communication with an outer environment of the inflatable body. A central processing unit couples to the panel. A pump couples to the controller. The pump is configured to inflate or discharge air from the inflatable body. The pump includes a housing defining an inflating port and a discharging port. A driving switch, located in the housing, couples to the controller to switch between two or more air passage configurations. A pressure sensor, coupled to the central processing unit, is in communication with the inflatable body to detect an internal pressure value of the inflatable body. The controller includes a wireless communication module. The wireless communication module is in communication with the central processing unit and a mobile terminal for remotely controlling the pump and the driving switch. The mobile terminal includes a terminal wireless communication module and a terminal input unit. The terminal wireless communication module is in communication with the wireless communication module. The terminal input unit is configured to provide at least an inflation signal input, a deflation signal input, or a stop signal input.

The air pump of the present invention accurately controls the inflation and deflation and/or provides supplemental airflow to the inflatable body remotely, without manual operation of the power switch and the air-passage switch of the inflatable product. This simplifies the preparation work before use and the arrangement work after use This also effectively avoids the problem of the inflation pressure being too high or too low, thereby prolonging the service life of the inflatable product. The air pump has a relatively low cost and a relatively simple production process, which is suitable for a variety of inflatable products and for large-scale industrial production and application.

BRIEF DESCRIPTION OF THE DRAWINGS

Other advantages of the embodiments of present invention will be readily appreciated, as same becomes better understood by reference to the following detailed description when considered in connection with the accompanying drawings wherein.

DESCRIPTION OF THE ENABLING EMBODIMENT

The implementation and use of the embodiments are discussed in detail below. However, it should be understood that the discussed specific embodiments only illustrate specific ways of implementing and using the present invention, and are not intended to limit the scope of the present invention. In the description of the structural positions of each component, directional representations such as upper, lower, top and bottom are not absolute, but relative. These directional representations are appropriate when the components are arranged, as shown in the figures, but when the positions of the components in the figures change, these directional representations change accordingly.

Figure 1:
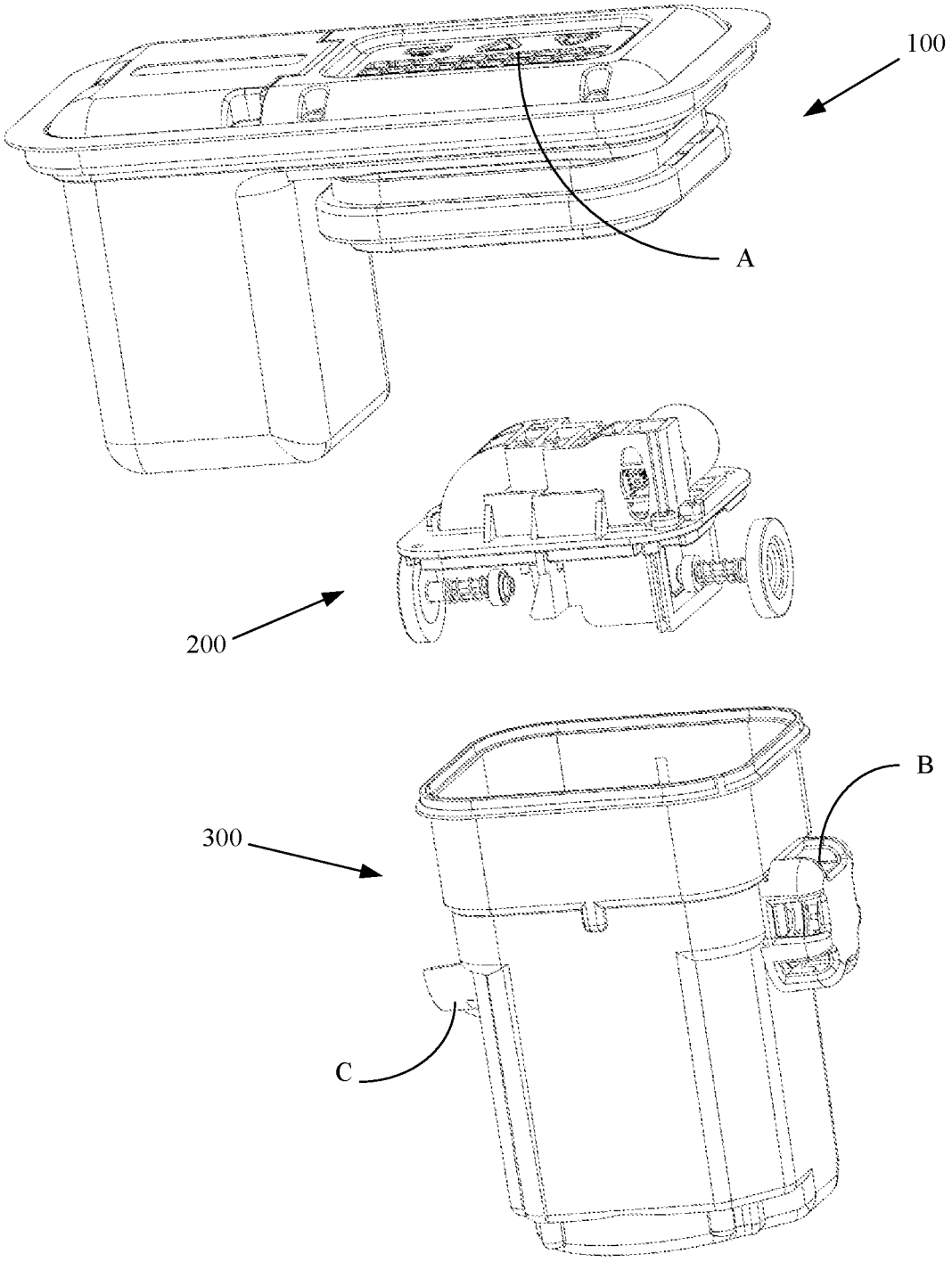
FIG. 1 is an exploded view of an air pump for an inflatable body constructed according to an embodiment of the present invention.
Figure 2:
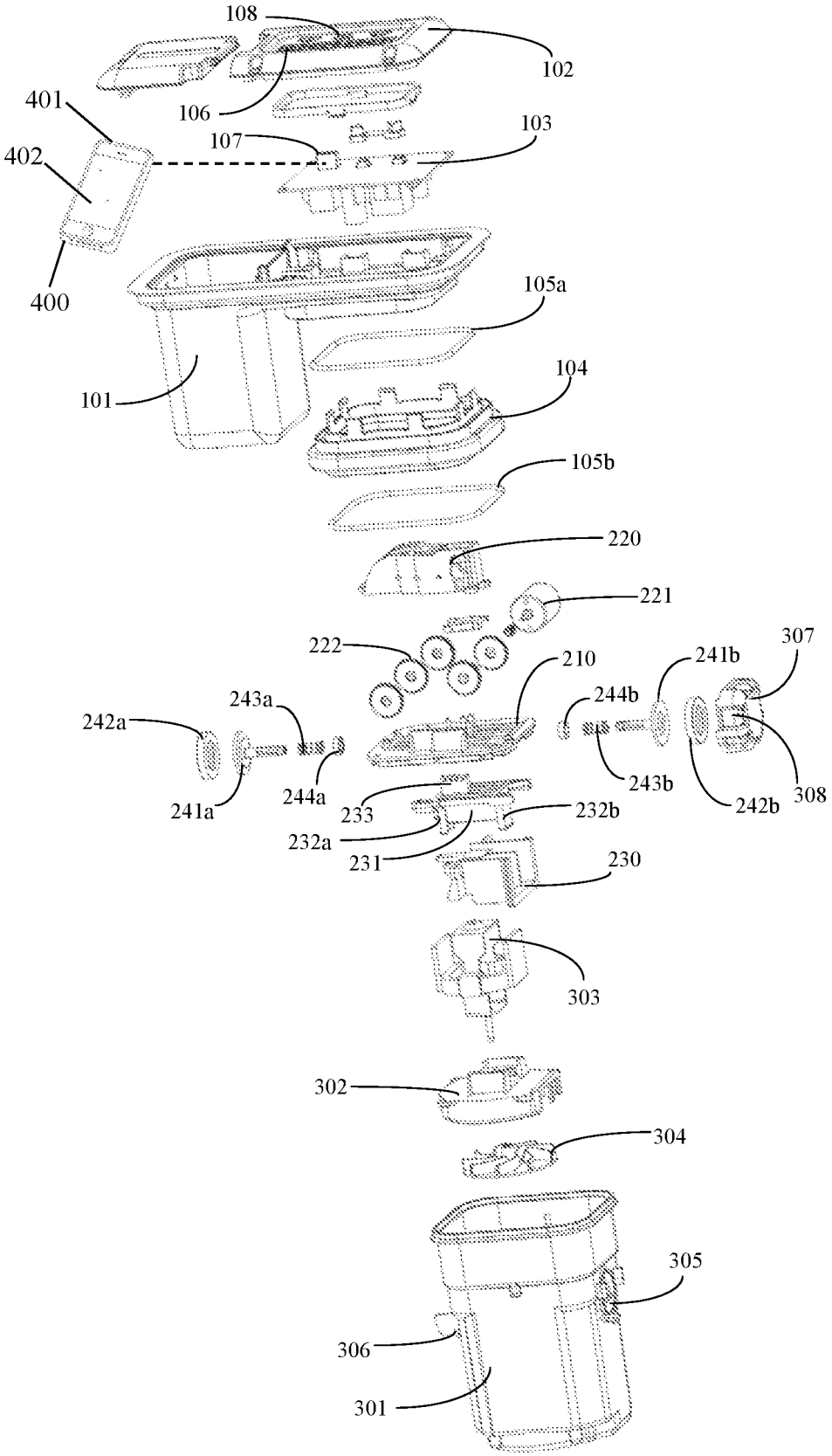
FIG. 2 is a detailed exploded view of the air pump of FIG. 1.

An air pump constructed according to one embodiment of the present invention is generally shown in FIGS. 1 and 2. The air pump comprises a controller 100, a driving switch 200 and a pump 300. The controller 100 defines an air inlet A in communication with the outer environment. The pump 300 defines an inflating port B and a discharging port C.

As best shown in FIG. 2, the controller 100 may include a panel 102 located on the outside of the inflatable body. A central processing unit 103 couples to the panel 102. The central processing unit 103 is electronic circuitry that executes instructions that make up a program for the controller 100. According to one embodiment of the present invention, the central processing unit 103 can be part of a Printed Circuit Board Assembly (PCBA). Optionally, the controller 100 may include a shell 101 defining an accommodating chamber. The shell 101 is sealed and connected with the panel 102 to accommodate and support the central processing unit 103 located therein. The panel 102 defines one or more openings 106 which forms the air inlet A. The shell 101 includes an installation interface for connection with the pump 300, for example, via an installation component 104. Accordingly, the pump 300 may include a housing 301 defining a chamber. The installation component 104 is sealingly coupled to the shell 101 of the controller 100 and the housing 301 of the pump 300 respectively via sealing members 105*a*, 105*b*. The side walls of the housing 301 of the pump 300, respectively define an inflating hole 305 forming the inflating port B and a discharging hole 306 forming the discharging port C. According to one embodiment of the present invention, the inflating port B can be located on one of the side walls, while the discharging port C can be located on another one of the side walls, e.g. opposite one another. It should be understood that the pump 300 is configured to inflate the inflatable body or discharge air from the inflatable body. According to one embodiment of the present invention, the pump 300 may include a fan blade shroud 302, a motor 303 and an impeller 304, which are accommodated in the housing 301. The fan blade shroud 302 divides the chamber of the housing 301 into a fan blade chamber and a driving chamber in communication with the outer space through the inflating hole 305 and the discharging hole 306. The impeller 304 is located in the fan blade chamber. The motor 303 is located in the driving chamber and is coupled to the impeller 304. According to one embodiment of the present invention, the motor 303 can be a variable speed motor.

The driving switch 200 is located in the housing 301 of the pump 300 and is in connection with the central processing unit 103 of the controller 100 such that the driving switch 200 switches between two or more air passage configurations based on signals transmitted by the central processing unit 103. According to one embodiment of the present invention, the two or more air passage configurations includes an inflation air passage configuration, a deflation air passage configuration and a closed air passage configuration.

As best illustrated in FIG. 2, the driving switch 200 includes a driving unit and an air-passage switch device. According to one embodiment of the present invention, the driving unit can be a steering motor 221 which drives the air-passage switch device to perform air passage configuration switching through different steering. The air-passage switch device may include a gear system 222 connected with the steering motor 221, a rack unit 231, 233 matched with the gear system 222 and a switch unit 240 driven by the rack unit 231, 233. A bracket 210 may be provided to assemble and support to the steering motor 221, the gear system 222, the rack unit 231, 233 and the switch unit 240. The gear system 222 can be a spur gear system and covered by a gear cover 220. The rack unit 231, 233 is configured to move back and forth, i.e. in a rectilinear motion or movement, at least between an inflation position, a deflation position and a stop position, such that the switch unit 240 can switch between the inflation air passage configuration, the deflation air passage configuration and the closed air passage configuration. For example, the rack unit 231, 233 can be located on an installation seat 230 and can move back and forth along a slideway arranged on the installation seat 230. According to one embodiment of the present invention, the rack unit 231, 233 may include a slider 231 with a rack 233, and the switch unit 240 may include a pair of valve plugs 242*a*, 242*b* symmetrically arranged on two ends 232*a*, 232*b* of the slider 231. According to one embodiment of the present invention, the inflating port B and the discharging port C are located opposite of one another, whereby the inflating port B receives a valve plug 242*b* of the pair of valve plugs 242*a*, 242*b* and the discharging port C receives another valve plug 242*a* of the pair of valve plugs 242*a*, 242*b*. Each valve plug 242*a*, 242*b* of the pair of valve plugs 242*a*, 242*b* includes a valve stem 241*a*, 241*b* connecting to the valve plug. In this way, a rectilinear movement of the rack unit 231, 233 can move to contact and push one of the valve stem 241*a*, 241*b* to move, thereby forcing the corresponding valve plugs 242*a*, 242*b* to engage or disengage with the side walls of the housing 301, and therefore, closing or opening the inflating port B or the discharging port C. According to one embodiment of the present invention, the switch unit 240 may also include an elastic member 243*a*, 243*b*, e.g. a spring, located on each of the valve stems 241*a*, 241*b*. In response to the rack unit 231, 233 moving toward the inflating port B, the elastic member 243*a* located adjacent to the discharge port C biases the valve plug 242*a*, received in the discharge port C, to engage a side wall of the housing 301 to close the discharge port C. In response to the rack unit 231, 233 moving toward the discharging port C, the elastic member 243*b* located adjacent to the inflating port B biases the valve plug 242*b*, received in the inflating port B, to engage a side wall of the housing to close the inflating port B. The springs may be limited by limiting members 244*a*, 244*b* sleeved on the valve stems 241*a*, 241*b*, such that the valve stems 241*a*, 241*b* can be elastically restored, so that the valve plugs 242*a*, 242*b* are engaged with the side walls of the housing after the slider 231 moves away from the valve stems 241*a*, 241*b*, thereby closing or opening the inflating port B or the discharging port C.

According to one embodiment of the present invention, a one-way valve may be provided at the inflating hole 305 and/or the discharging hole 306 to avoid leakage during inflation or deflation. As illustrated in FIG. 2, the pump 300 may also include a protection cover 307 covering the inflation hole 305 to protect the one-way valve located therein. The protection cover 307 may define a plurality of grooves 308 to facilitate airflow.

It should be understood that, in order to implement precise inflating and discharging air from the inflatable body, the air pump also includes a pressure sensor coupled to the central processing unit 103. The pressure sensor is in communication with the inflatable body to detect an internal pressure value of the inflatable body. Based on the detected internal pressure value and a preset inflation pressure value of the air pump, the central processing unit 103 can send start or stop signals to control the air pump to inflate and discharge air or stop. For example, when the detected internal pressure value is less than the preset inflation pressure value, the central processing unit 103 sends a driving signal to the driving switch 200 to switch to the inflation air passage configuration, and sends a start signal to start the air pump to inflate at the same time. When the detected internal pressure value is greater than the preset inflation pressure value, the central processing unit 103 sends a driving signal to the driving switch 200 to switch to the deflation air passage configuration to discharge air until the preset inflation pressure value is reached. In addition, when the central processing unit 103 receives a stop instruction, it can send the stop signal to the driving switch 200 to switch to the closed air passage configuration. In some embodiments, the preset inflation pressure value can be set in the central processing unit 103 or input by the user to facilitate the user adjusting the hardness and softness of the inflatable body, as required.

According to one embodiment of the present invention, the controller 100 includes a wireless communication module 107. The wireless communication module 107 is in communication with the central processing unit 103 and the mobile terminal 400 to implement remote control of the air pump 300 and the driving switch 200. Accordingly, the inflating and discharging functions, as well as the stopping function can be remotely controlled via the mobile terminal 400. In some embodiments of the present invention, one or more functional modules can be additionally provided thereby allowing safe and effective inflating and discharging operations for the inflatable body without considering space or even time factors. Alternatively, the functional modules can include a timing reservation module, a heating module, an audio module and a lighting module installed on the air pump or externally connected to the air pump.

More specifically, the mobile terminal 400 may include a terminal wireless communication module 401 and a terminal input unit 402. The terminal wireless communication module 401 communicates with the wireless communication module 107 of the controller 100. The terminal input unit 402 is configured to provide an inflation signal input, a deflation signal input, or a stop signal input. In some embodiments of the present invention, the controller 100 may also include a panel input unit 108 arranged on the panel 102 to facilitate with the manual operation of the air pump. The panel input unit 108 couples to the central processing unit 103 for providing the inflation signal input, the deflation signal input, or the stop signal input.

According to one embodiment of the present invention, the mobile terminal 400 may comprise a smartphone, a tablet computer, or a laptop computer with wireless function. The terminal input unit 402 includes a touch control module and/or a voice module. Similarly, the panel input unit 108 may be configured as a keypad or a touch screen. In this way, the remote operation of the pump 300 and the driving switch 200 can be implemented via the touch and voice functions of the mobile phone itself through an application program on the mobile phone. By inputting the operation using the application program, the operation of each functional module can also be implemented. It should be understood that the communication between the wireless communication module 107, the terminal wireless communication module 401 and the central processing unit 103 can be achieved in a variety of ways such as, but not limited to, WIFI, Bluetooth, 433M wireless module or infrared.

According to one embodiment of the present invention, the mobile terminal 400 may also include a terminal display unit for displaying at least one of an inflation state, a deflation state, a stop state, a preset inflation pressure value, a preset deflation pressure value, a working pressure value, or an abnormal alarm state. In some embodiments, the controller 100 may also include a panel display unit connected with a central processing unit to display the inflation state, the deflation state, the stop state, the preset inflation pressure value, the preset deflation pressure value, the working pressure value, or the abnormal alarm state. Optionally, the panel display unit may comprise a display lamp, an electronic display screen or a touch screen. The terminal display unit may be, for example, display screen on the mobile phone.

The operational process of the air pump constructed according one embodiment of the present invention will be described below in view of FIGS. 3 through 7*b*.

Figure 7A:
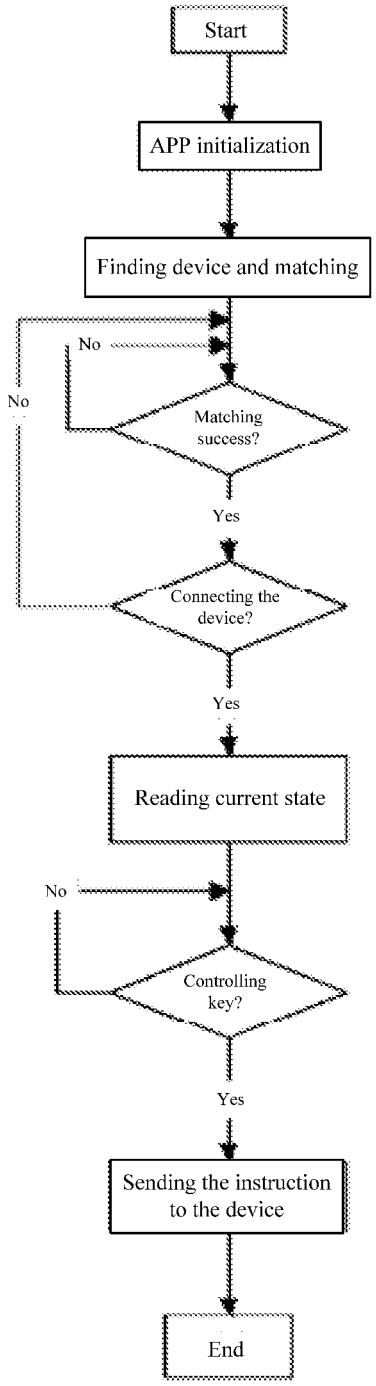
FIG. 7*a* is a flowchart showing the operation a mobile terminal according to an embodiment of the present disclosure.
Figure 7B:
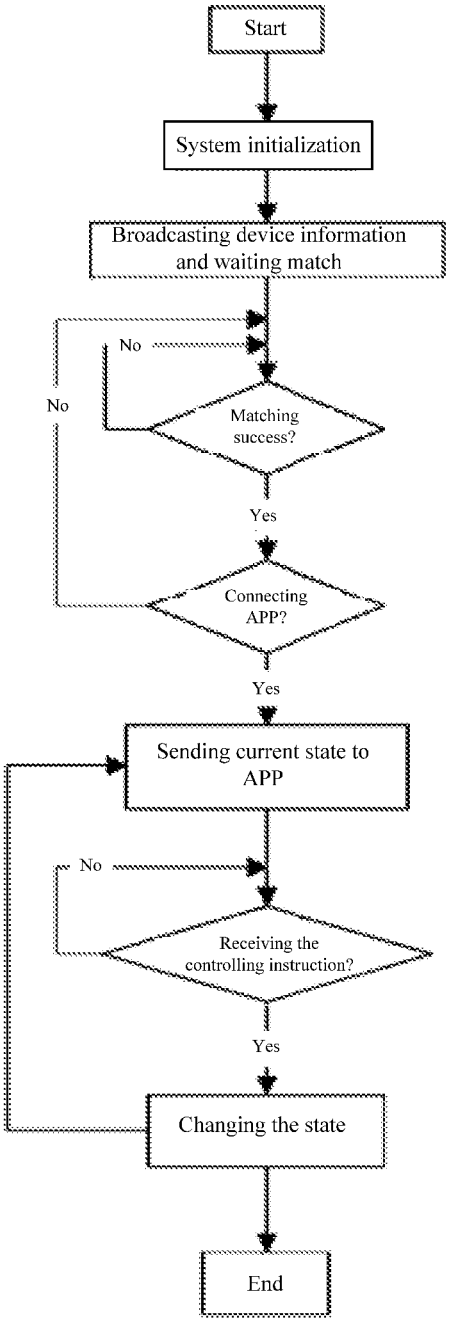
FIG. 7*b* shows a flowchart of the air pump wirelessly communicated with the mobile terminal according to an embodiment of the present invention.

First, as illustrated in FIGS. 7*a* and 7*b*, a mobile phone is used as the mobile terminal 400, and the wireless communication and operation is performed with a mobile phone APP (or application) via Bluetooth. FIG. 7*a* shows a flowchart of the mobile phone application for establishing the communication matching and key control with the controller 100 of the air pump. FIG. 7*b* shows a flowchart of the air pump communicating with the mobile phone application and implementing state or air passage configuration switching based on control instructions received from the mobile phone application.

Figure 6:
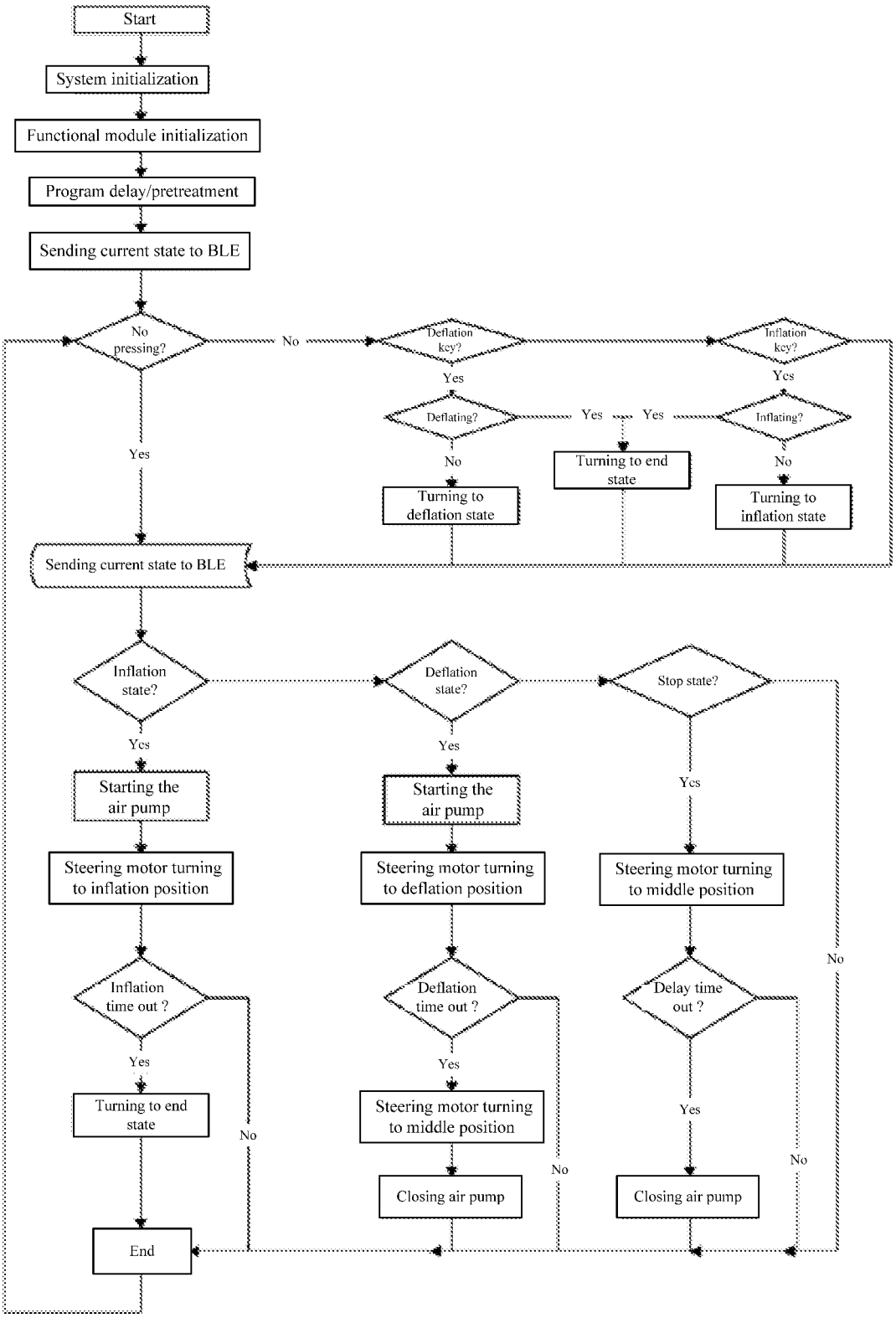
FIG. 6 is a flowchart for the air pump according to an embodiment of the present invention.

FIG. 6 shows a flowchart for remotely controlling the air pump to inflate (or charge) and deflate (or discharge) air. Here, wireless communication and control operations are implemented in a Bluetooth Low Energy (BLE) mode. It should be understood that the central processing unit 103 (such as PCBA) of the controller 100 can intelligently control the driving switch 200 to switch the air passage configurations and push the valve stems 241*a*, 241*b* to open the inflation or deflation air passage configurations, the pump 300 operating at the same time to inflate or deflate the inflatable product. On the other hand, when the driving switch 200 switches the air passage configuration to a close air passage configuration wherein the driving switch 200 disconnects from the valve stems 241*a*, 241*b*, the air pump stops operating.

Figure 3:
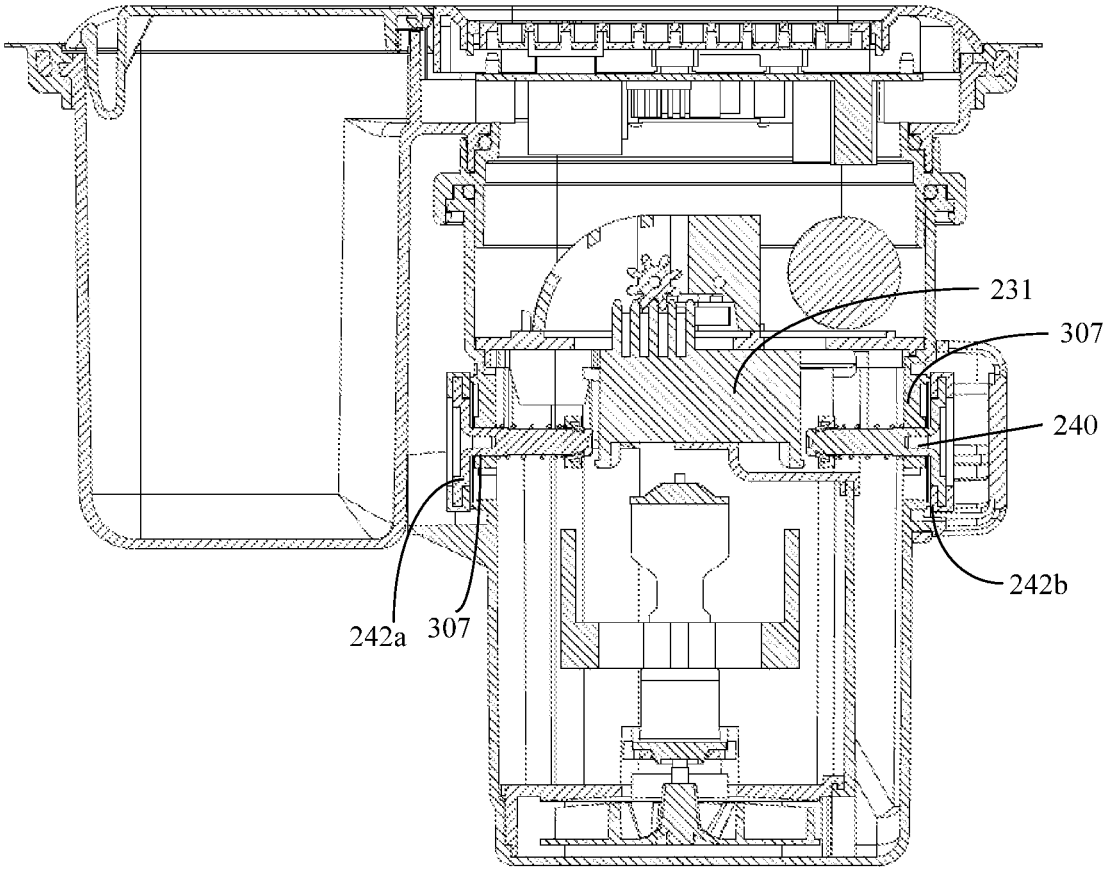
FIG. 3 is a cross-sectional side view of the air pump in a stop position.
Figure 4:
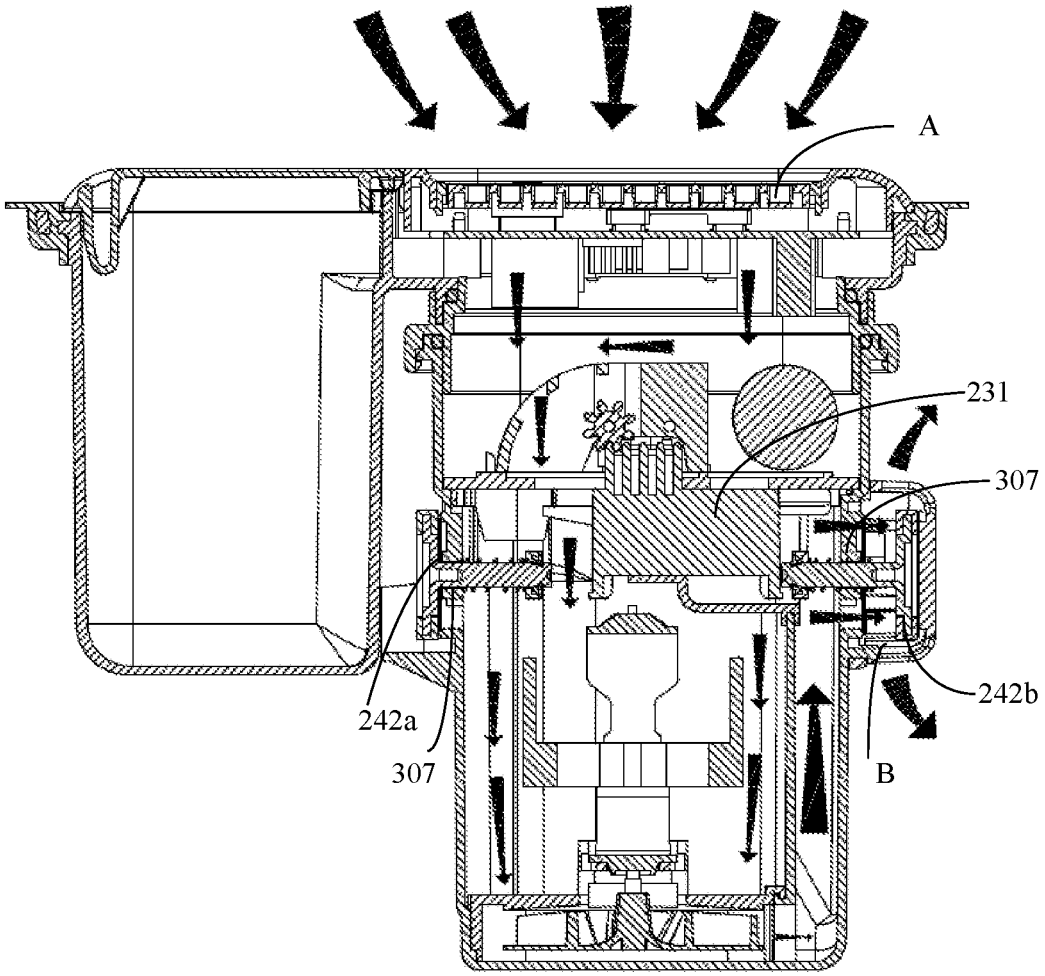
FIG. 4 is a cross-sectional schematic view of the air pump in an inflation position.
Figure 5:
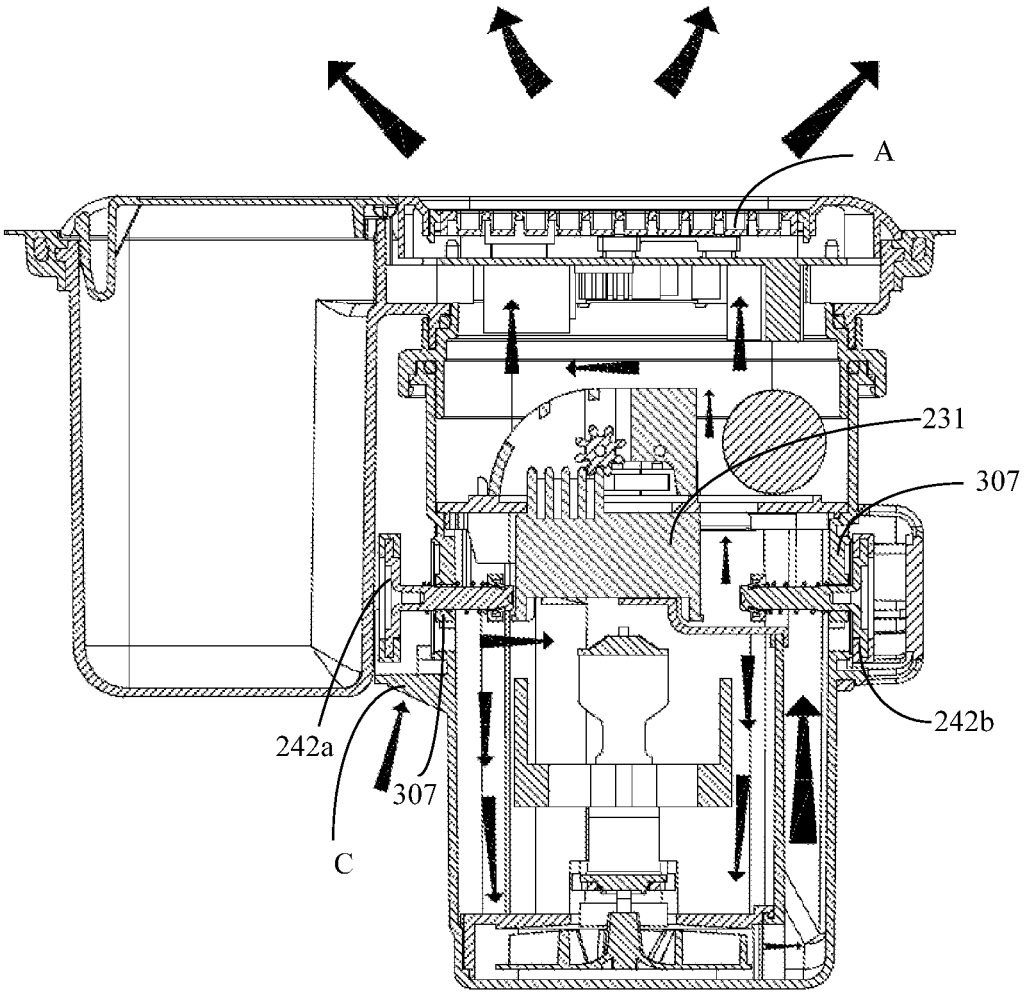
FIG. 5 is a cross-sectional schematic view of the air pump in a deflation position.

Referring to FIGS. 3 to 5, when the air pump is in a non-operating state or the stop state, as best shown in FIG. 3, the steering motor 221 is not in operation. In addition, the slider 231 of the rack unit 231, 233 is in a middle position wherein the slider 231 is spaced apart from the valve stems 241*a*, 241*b*. At this time, the left valve plug 242*a* and the right valve plug 242*b* are all in engagement with the side walls 307 of the housing 301 to establish the close air passage configuration.

When the pressure sensor detects the internal pressure value of the inflatable body being less than the preset inflation pressure value, the PCBA remotely sends the start signal to the steering motor 221. In response, the steering motor 221 rotates forward, e.g. in a clockwise rotational direction, and drives the gear system 222 to rotate. Due to the mesh engagement between the gear system 222 and the rack unit 231, 233, the steering motor 221 moves the slider 231 rightward, and the slider 231 contacts and pushes the valve stem 241*b* to disengage the valve plug 242*b* from the side wall of the housing 301. At this time, the inflation air passage configuration is established, while the deflation air passage configuration remains closed. FIG. 4 illustrates the pump being in an inflation state. In the inflation state, external air enters the air pump through the air inlet A, as indicated by the arrows, and then enters the interior of the inflatable body through the inflating port B until an inflation completion, wherein the internal pressure value detected by the pressure sensor is equal to the preset inflation pressure value. After the inflation completion, the PCBA remotely sends the stop signal. In response, the steering motor 221 rotates in a reverse direction, e.g. in a counter clockwise rotational direction, and drives the gear system 222 to rotate. Due to the mesh engagement between the gear system 222 and the rack unit 231, 233, the slider 231 moves leftward to separate from the valve stem 241*b* and returns to the middle position. The valve stem 241*b* is elastically restored and the valve plug 242*b* engages the side wall to establish the closed air passage configuration, i.e. in the stop state.

When the detected internal pressure value is greater than the preset inflation pressure value, the PCBA remotely sends the start signal to the steering motor 221. In response, the steering motor 221 rotates in the reverse direction, e.g. in a counter clockwise rotational direction, and drives the gear system 222 to rotate. Due to the mesh engagement between the gear system 222 and the rack unit 231, 233, the slider 231 moves leftward pushing the valve stem 241*a* such that the valve plug 242*a* disengages from the side wall of the housing 301. At this time, the deflation air passage configuration is established and the inflation air passage configuration remains closed. FIG. 5 illustrates the air pump being in a deflation state. In this deflation state, the air in the inflatable body enters the air pump through the discharging port C, as indicated by the arrows, and is discharged from the air pump through the air intake A until the detected internal pressure value reaches the preset inflation pressure value. After completion of the discharging, the PCBA remotely sends the stop signal. In response, the steering motor 221 rotates forward, e.g. in a clockwise rotation, and drives the gear system 222 to cause the slider 231 to move rightward to separate the slider 231 from the valve stem 241*a* and return to the middle position. The valve stem 241*a* is automatically and elastically restored and the valve plug 242*a* engages with the side wall to establish the close the deflation passage configuration, i.e. in the stop state.

According to one embodiment of the present invention, the air pump may also include a supplementary air pump. The supplementary air pump connects to the central processing unit 103 to supplement airflow to the inflatable body. For example, the supplementary air pump can be arranged in the shell 101 of the controller 100. Compared to the pump 300, with relatively large power for rapid inflation, the supplementary air pump usually adopts an air pump with smaller output power and lower noise level to make the airflow supplementary process slow and continuous. Accordingly, this provides a feeling that the inflatable body is constantly in a relatively stable air pressure state for a long duration. In addition, it would be difficult to detect noise generated from the supplementary air pump when supplementing airflow. Similarly, the air supplementary operation can also be remotely controlled by the mobile terminal 400. Accordingly, the terminal input unit 402 and the terminal display unit of the mobile terminal 400, and optionally, the panel input unit and the display unit of the control panel module can be provided with an air supplementary signal input and related display.

According to some embodiments of the present invention, the air supplementary operation may be implemented as follows. When the air pump is in the deflation state or the stop state, the supplementary air pump remains inoperative. When the air pump begins to inflate, i.e. in the inflation state, the PCBA does not send the start signal to the supplementary air pump. Accordingly, the supplementary air pump is in a standby state. After the internal air pressure value reaches the preset inflation pressure value, the PCBA sends the start signal to the supplementary air pump to initiate the operation of the supplementary air pump. The supplementary air pump continues to operate until the internal air pressure value reaches a preset supplementary pressure value. When the internal air pressure value reaches the preset supplementary pressure value, the PCBA sends the stop signal to the supplementary air pump. The airflow supplementary is repeated periodically to maintain the internal air pressure value of the inflatable product. It should be noted that the preset air supplementary pressure can be less than or equal to the preset inflation pressure value. In addition, the preset air supplementary pressure can be set in the central processing unit 103, or can be set by the users themselves.

The air pump constructed according to the present invention effectively guarantees the inflating and discharging of the inflatable body through remote control. In addition, the air pump constructed according to the present invention can provide supplemental airflow to the inflatable body through remote control. Accordingly, the air pump of the present invention improves user's experience by maintaining the internal pressure value of the inflatable body relatively stable for a long time. The air pump also reduces the power consumption and prolongs the service life. It should be appreciated that the inflatable body can be various inflatable parts such as, but not limited to, inflatable bed, inflatable mattress, inflatable boat or inflatable toy.

It should be understood here that the embodiments as shown in FIGS. 1 to 5 only show the shapes, sizes and arrangements of the various optional components of the air pump for the inflatable body according to one embodiment of the present invention, but they are for illustration purposes only, and other shapes, sizes and arrangements can be adopted without departing from the idea and scope of the present invention. Similarly, the operation flows as shown in FIGS. 6, 7*a* and 7*b* are only examples, which can be changed according to different needs within the scope of the present invention.

The technical contents and technical features of the present invention have been disclosed above. However, it should be understood that those skilled in the art can make various changes and improvements to the above-mentioned concept, which all belong to the protection scope of the present invention.

What is claimed is:

1. An air pump for an inflatable body, comprising:

a controller having a panel located outside of the inflatable body, said panel defining an air inlet in communication with an outer environment of the inflatable body;

a central processing unit coupled to said panel;

a pump coupled to said controller, said pump configured to inflate or discharge air from the inflatable body, said pump including a housing defining an inflating port and a discharging port;

a driving switch located in said housing and coupled to said controller to switch between two or more air passage configurations, wherein said driving switch includes a driving unit and an air-passage switch device, said driving unit being coupled to said central processing unit for moving said air-passage switch device between said two or more air passage configurations, wherein said driving unit comprises a steering motor, wherein said air-passage switch device comprises a gear system coupled to said steering motor, a rack unit matched with said gear system, and a switch unit driven by said rack unit, wherein said rack unit is rectilinearly moveable between an inflation position, a deflation position, and a stop position to enable said switch unit to switch between said two or more air passage configurations, wherein said rack unit includes a slider comprising a rack and said switch unit comprises a pair of valve plugs arranged such that each one of said pair of valve plugs is disposed at a respective end of said slider, wherein each valve plug of said pair of valve plugs has a valve stem, whereby a rectilinear movement of said rack unit pushes one of said valve stems outward to open said inflating port or said discharging port, wherein said switch unit includes an elastic member located on each of said valve stems, wherein, in response to said rack unit moving toward said inflating port, said elastic member located adjacent to said discharge port biases said valve plug, received in said discharge port, to engage a side wall of said housing to close said discharge port, and wherein, in response to said rack unit moving toward said discharge port, said elastic member located adjacent to said inflating port biases said valve plug, received in said inflating port, to engage a side wall of said housing to close said inflating port; and a pressure sensor, coupled to said central processing unit, in communication with the inflatable body to detect an internal pressure value of the inflatable body;

wherein said controller includes a wireless communication module, said wireless communication module in communication with said central processing unit and a mobile terminal to remotely control said pump and said driving switch; and wherein said mobile terminal includes a terminal wireless communication module and a terminal input unit, said terminal wireless communication module being in communication with said wireless communication module, and said terminal input unit is configured to provide at least an inflation signal input, a deflation signal input, or a stop signal input.

2. The air pump according to claim 1, wherein said wireless communication module and said terminal wireless communication module comprise wireless network modules, short-range wireless modules, or infrared wireless modules.

3. The air pump according to claim 1, wherein said mobile terminal comprises one of a smart phone, a tablet computer, and a laptop computer; and said terminal input unit comprises a touch control module and/or a voice module.

4. The air pump according to claim 1, wherein said mobile terminal includes a terminal display unit for displaying at least one of an inflation state, a deflation state, a stop state, a preset inflation pressure value, a preset deflation pressure value, a working pressure value, or an abnormal alarm state.

5. The air pump according to claim 1, wherein said controller includes a panel input unit located on said panel, and said panel input unit is connected to said central processing unit for providing said inflation signal input, said deflation signal input, or said stop signal input.

6. The air pump according to claim 5, wherein said panel input unit comprises a keypad or a touch screen.

7. The air pump according to claim 1, wherein said controller includes a panel display unit coupled to said central processing unit for displaying an inflation state, a deflation state, a stop state, a preset inflation pressure value, a preset deflation pressure value, a working pressure value, or an abnormal alarm state.

8. The air pump according to claim 7, wherein said panel display unit comprises a display lamp, an electronic display screen, or a touch screen.

9. The air pump according to claim 1, wherein said two or more air passage configurations includes an inflation air passage configuration, a deflation air passage configuration, or a closed air passage configuration.

10. The air pump according to claim 9, wherein said inflating port and said discharging port are located opposite of one another whereby said inflating port receives a valve plug of said pair of valve plugs and said discharging port receives another valve plug of said pair of valve plugs.

11. The air pump according to claim 1, further including a supplementary air pump coupled to said central processing unit to supplement airflow to the inflatable body.

12. The air pump according to claim 1, further including a functional module coupled to said central processing unit to implement one or more additional functions.

13. The air pump according to claim 12, wherein said functional module includes a timing reservation module, a heating module, an audio module, or a lighting module, the functional module being installed on the air pump or externally connected to the air pump.

14. The air pump according to claim 1, wherein the inflatable body comprises an inflatable bed, an inflatable mattress, an inflatable boat or an inflatable toy.

* * * * *